US007213437B2

(12) United States Patent
Osumi et al.

(10) Patent No.: US 7,213,437 B2
(45) Date of Patent: May 8, 2007

(54) BENT-FORMING METHOD

(75) Inventors: Akira Osumi, Kakogawa (JP); Jiro Iwaya, Kakogawa (JP); Takayuki Yamano, Kakogawa (JP)

(73) Assignee: Kabushiki Kaisha Kobe Seiko Sho (Kobe Steel, Ltd.), Kobe-shi (JP)

( * ) Notice: Subject to any disclaimer, the term of this patent is extended or adjusted under 35 U.S.C. 154(b) by 48 days.

(21) Appl. No.: 11/138,495

(22) Filed: May 27, 2005

(65) Prior Publication Data

US 2005/0262917 A1 Dec. 1, 2005

(30) Foreign Application Priority Data

Jun. 1, 2004 (JP) ..... 2004-163115
Dec. 2, 2004 (JP) ..... 2004-349473

(51) Int. Cl.
*B21D 31/00* (2006.01)

(52) U.S. Cl. ..... 72/379.2; 72/415

(58) Field of Classification Search ..... 72/379.2, 72/415, 412, 414, 702
See application file for complete search history.

(56) References Cited

U.S. PATENT DOCUMENTS 4,373,371 A * 2/1983 Liu ..... 72/374
6,748,788 B2 6/2004 Yamano et al.
2003/0061852 A1 4/2003 Yamano et al.

OTHER PUBLICATIONS

Patent Abstracts of Japan, JP 04-147718, May 21, 1992.

* cited by examiner

*Primary Examiner*—Ed Tolan
(74) *Attorney, Agent, or Firm*—Oblon, Spivak, McClelland, Maier & Neustadt, P.C.

(57) ABSTRACT

In a first forming step, a metal sheet placed on, and held by a provisional horizontal flat forming portion of a first forming die part is bent along a provisional bend forming portion of the first forming die part to execute bent-forming such that two arch parts of the metal sheet, having respective protuberances oriented in directions opposite from each other, with protuberance surfaces being butted against a provisional inclined flat forming portion of a second forming die part, and a provisional inclined flat forming portion of the first forming die part, respectively, are coupled with each other, thereby obtaining a provisional formed member comprising a provisional inclined flat portion without any warpage, formed continuously from a provisional horizontal flat portion via a provisional bend, and a flange portion formed continuously from the provisional inclined flat portion so as to form a target angle. Subsequently, in a second forming step, the provisional formed member is formed into a target shape by causing the provisional bend to undergo deformation by bending back while bent-forming the provisional horizontal flat portion.

5 Claims, 8 Drawing Sheets

BENT-FORMING METHOD

BACKGROUND OF THE INVENTION

1. Field of the Invention

The present invention relates to a bent-forming method for forming a formed member such as a car part, and the like by bending a metal plate, and in particular, to prevention of shape defectives from occurring to the formed member, caused by elastic recovery after removal of the formed member from forming dies.

2. Description of the Related Art

In recent years, reinforcement as well as reduction in weight of a car body and its parts have been promoted in an attempt to attain objects of mileage improvement, environmental conservation, safety improvement, and so forth, and progress has been made in use of a lighter material, such as a steel sheet of high-tension, an aluminum alloy sheet, and so forth, for press-formed members of a metal sheet, accounting for the majority of constituent parts of the car body, as one of means for achieving the objects.

For example, FIG. 1A shows a Z-shaped member as a press-formed member, comprising an horizontal flat portion 1, a inclined flat portion 3 continuing from one end of the horizontal flat portion 1 via a first bend 2, and having one end thereof, extended downward, and a flange portion 5 coupled to the other end of the inclined flat portion 3 via a second bend 4, so as to be parallel with the horizontal flat portion 1, and FIG. 1B shows a hat-channel shaped member formed by disposing the Z-shaped members in bilateral symmetry.

A problem with press-forming of a metal sheet such as a high-tension steel sheet, and the like is that large elastic recovery (springback) occurs upon removing the metal sheet from a forming die, resulting in deterioration in dimensional accuracy of a formed member. This is shown in FIG. 2 by taking an example of the hat-channel shaped member. In the figure, a member shape (target shape) of the hat-channel shaped member before removal from the forming die is indicated by dash and double dashed lines while a member shape thereof after removal from the forming die is indicated by solid lines. An angle change defect $\Delta\theta p$ (an angle formed between a tangent to a bend-stop face of the first bend, on a side thereof, adjacent to the inclined flat portion, and the inclined flat portion in a target formed shape) occurs to the first bend 2, and warpage curved outward (a maximum parting distance between the warpage and a line segment interconnecting bend-stop points at respective ends of the inclined flat portion is denoted by $\delta$) occurs to the inclined flat portion 3 subjected to bending by bending-back. The bending by the bending-back refers to a phenomenon where after a sheet has once been formed by bending, a bent portion of the sheet is subjected to forming by bending, in a direction opposite to a direction of an initial forming by bending at the outset (bending-back), and a bent-back portion undergoes springback in the direction of the initial bending at the outset to be thereby deformed. Due to the angle change defect and warpage as described, an opening with an opening distance $\Delta D$ (a horizontal distance between the lower end of the inclined flat portion in the formed shape of the hat-channel shaped member after removal from the forming die, and that of the inclined flat portion in the target formed shape) occurs to the respective lower ends of the inclined flat portions 3 of the hat-channel shaped member. In this connection, the respective lower ends of the inclined flat portions of the hat-channel shaped member (the same applied to the Z-shaped member) refer to respective portions thereof, corresponding to an intersection of the inner face of the inclined flat portion, and an extension of the underside face of the flange portion.

As methods for preventing shape change defects from occurring to the formed member, there have been proposed, for example, a method of forming a reverse bending radius portion, oriented in a direction opposite from a bending direction for forming, along the ridge of a bend, and a method of providing compression stress in the direction of a sheet thickness at a bend, thereby reducing residual stress. Those methods, however, have problems of providing an originally unavailing shape, requiring special equipment, and so forth. Meanwhile, a forming method for improving shape defects without the problems described have been proposed in U.S. Pat. No. 6,748,788, and the 53rd Plastic Working Joint Conference Proceedings, pp. 251 to 252. As shown in FIG. 3, with this method, when a metal sheet P is formed by bending with a bending blade 52 descending toward a forming punch 51, the metal sheet P is bent in an arch-like shape along a bend forming portion 55 of the forming punch 51, and as the bending blade 52 further descends, portions of the surface of the metal sheet P, on a protruded side, are butted against an inclined flat forming portion 58 of the bending blade 52, and an inclined flat forming portion 56 of the forming punch 51, respectively, whereupon the metal sheet P is formed so as to undergo deformation such that arched parts A1, A2, having respective protuberances oriented in directions opposite from each other, are formed so as to be coupled with each other, thereby checking the angle change defect $\Delta\theta p$ at the first bend 2, and the warp $\delta$ of the inclined flat portion 3 as described with reference to the Z-shaped member, and the hat-channel shaped member. Incidentally, a deformation behavior where the two arched parts A1, A2, having the respective protuberances oriented in directions opposite from each other, are formed so as to be coupled with each other is referred to as "dancing".

With adoption of the forming method utilizing the dancing described, it has become possible to suppress the angle change defect $\Delta\theta p$ occurring to the first bend 2, and the warpage $\delta$ occurring to the inclined flat portion 3 with reference to the Z-shaped member, and the hat-channel shaped member. However, in order to suppress such deformations as described, it has been necessary to form an bent angle $\theta p$ of the bend forming portion 55 of the forming punch 51 so as to be an obtuse angle, posing therefore a problem that a formed shape is inevitably a particular shape in which the inclined flat portion 3 is inclined to the horizontal flat portion 1. Furthermore, there has arisen another problem that with reference to an angle $\theta d$ formed between the inclined flat portion 3, and the flange portion 5, an angle change defect $\Delta\theta d$ comes to be observed larger as the angle $\theta d$ becomes closer to a right angle.

SUMMARY OF THE INVENTION

In view of the problems described as above, the invention has been developed, and it is an object of the invention to provide a bent-forming method enabling bent-forming to be implemented with ease without causing angle change defects and warpage even in the case where an angle formed between the horizontal flat portion, and the inclined flat portion as well as the angle formed between the inclined flat portion, and the flange portion is a right angle when forming the Z-shaped member, and the hat-channel shaped member, having the flange portion, and another object of the invention is to provide forming dies for use in carrying out the bent-forming method.

The inventor, et al. have obtained knowledge that it is difficult to form a metal plate into a target shape in one stage when forming the Z-shaped member, and the hat-channel shaped member, however, if a provisional inclined flat portion, which is provisionally formed, and a flange portion coupled to the provisional inclined flat portion are first formed in a first forming step by taking advantage of "dancing" occurring when the provisional inclined flat portion is formed, this enables forming to be implemented, causing neither warpage occurring to the provisional inclined flat portion, nor an angle change defect occurring to an angle θd formed between the provisional inclined flat portion, and the flange portion. Further, it has been found out that when forming a provisional horizontal flat portion coupled to one end of the provisional inclined flat portion in a second forming step, if a provisional bend is formed between the provisional horizontal flat portion, and the provisional inclined flat portion so as to undergo bending back, a member in the target shape can be formed without causing an angle change defect occurring to an angle θp formed between the horizontal flat portion, and the inclined flat portion after forming operation. The invention is developed on the basis of the knowledge described as above.

More specifically, a bent-forming method according to the invention is a bent-forming method for bent-forming a metal plate into a Z-shaped member, or a hat-channel shaped member, having a horizontal flat portion, an inclined flat portion with one end thereof, coupled to one end of the horizontal flat portion via a first bend, and a flange portion coupled to the other end of the inclined flat portion, via a second bend comprising a first forming step for bent-forming the metal plate into a provisional formed member having a provisional inclined flat portion with one end thereof, coupled to one end of a provisional horizontal flat portion via a provisional bend, the other end of the provisional inclined flat portion, being coupled to a flange portion via the second bend, and a second forming step for forming the horizontal flat portion, first bend, and inclined flat portion, so as to be continuously coupled with each other, out of the provisional horizontal flat portion, provisional bend, and provisional inclined flat portion of the provisional formed member, respectively. The first forming step forms the provisional inclined flat portion by causing the same to undergo deformation so as to form two arch parts thereof, having respective protuberances oriented in directions opposite from each other between respective provisional inclined flat forming portions of forming die parts in pairs for forming the provisional inclined flat portion when forming the provisional inclined flat portion, and the second forming step bent-forms the provisional horizontal flat portion of the provisional formed member while forming the provisional bend by bending back.

The bent-forming method described can be executed with ease preferably by use of the following two forming dies. First, there are prepared a first forming die comprising a first forming die part having a provisional horizontal flat forming portion coupled to a provisional inclined flat forming portion via a provisional bend forming portion, and a flange forming portion coupled to the provisional inclined flat forming portion, and a second forming die part having a provisional inclined flat forming portion for bent-forming the metal sheet in conjunction with the provisional inclined flat forming portion, and the flange forming portion of the first forming die part, respectively, and a flange forming portion, and a second forming die comprising a first forming die part having a horizontal flat forming portion coupled to a inclined flat forming portion via a bend forming portion, and a second forming die part having an inclined flat forming portion for bent-forming the provisional horizontal flat portion of the provisional formed member along the bend forming portion in conjunction with the inclined flat forming portion of the first forming die part. By causing the second forming die part of the first forming die to make relative displacement against the first forming die part of the first forming die in the first forming step, the metal sheet placed on, and held by the provisional horizontal flat forming portion of the first forming die part is bent into an arch-like shape along the provisional bend forming portion of the first forming die part to be formed in such a way as to undergo deformation such that a first arch part, and a second arch part of the metal sheet, having respective protuberances oriented in directions opposite from each other, with protuberance surfaces being butted against the provisional inclined flat forming portion of the second forming die part, and the provisional inclined flat forming portion of the first forming die part, respectively, are coupled with each other, thereby forming the provisional formed member having the provisional inclined flat portion with the one end thereof, coupled to the one end of the provisional horizontal flat portion via the provisional bend, the other end of the provisional inclined flat portion, being coupled to the flange portion via the second bend.

Further, in the second forming step, the provisional horizontal flat portion of the provisional formed member is bent-formed by causing the second forming die part of the second forming die to make relative displacement against the first forming die part of the second forming die, and the provisional bend is formed by bending back.

An angle θp1 formed between the provisional horizontal flat forming portion, and the provisional inclined flat forming portion of the first forming die part of the first forming die is preferably rendered to be an obtuse angle, more preferably an angle in a range of about 105 to 150°, thereby enabling dancing to occur to the provisional inclined flat forming portion with ease when forming the provisional inclined flat forming portion. Still further, forming by bending back is preferably executed such that a part of the provisional bend of the provisional formed member overlaps the bend forming portion of the first forming die part of the second forming die by placing the provisional horizontal flat portion of the provisional formed member on the horizontal flat forming portion of the first forming die part of the second forming die after a bend-stop point of the provisional bend of the provisional formed member, on a side thereof, adjacent to the provisional horizontal flat portion is slid outward from a bend-stop point of the bend forming portion of the first forming die part of the second forming die, on a side thereof, adjacent to the horizontal flat forming portion in the second forming step, thereby enabling a target angle to be formed by effectively preventing an angle change defect from occurring at the first bend.

Further, in the second forming step, if L is expressed by the following expression (1):

$$L=\Delta W+\pi\times rp\mathbf{1}\times(180-\theta p\mathbf{1})/180-\pi rp\mathbf{2}/2 \quad (1)$$

where rp1 is a curvature radius of the provisional bend forming portion of the first forming die part of the first forming die, rp2 a curvature radius of the bend forming portion of the first forming die part of the second forming die, and ΔW a slippage of the provisional formed member, ΔW is preferably provided so as to satisfy the following expression (2):

$$L0-\Delta L \leqq L \leqq L0+\Delta L \quad (2)$$

where $L0=\pi\times rp1\times(180-\theta p1)/180+0.0435\theta p1-6.253$, and $\Delta L=-9.96\times10^{-5}\times e^{k}+2.66$, $k=0.163\times(\theta p1-90)$ Furthermore, forming dies according to the invention, comprises the first forming die, and the second forming die, suitable for use in carrying out the bent-forming method according to the invention.

With the bent-forming method according to the invention, it is possible to concurrently form the provisional inclined flat portion having no warpage occurring thereto by taking advantage of the dancing, and the flange portion forming the target angle with the provisional inclined flat portion, in the first forming step, and it is possible to bent-form the Z-shaped member, and the hat-channel shaped member, as the target, in the second forming step, by preventing an angle change defect from occurring to the angle formed between the horizontal flat portion, and the inclined flat portion. Further, with the use of the forming dies according to the invention, the bent-forming method can be easily executed by use of an ordinary pressing apparatus, resulting therefore in excellent productivity.

DESCRIPTION OF THE PREFERRED EMBODIMENTS

Figure 1A:
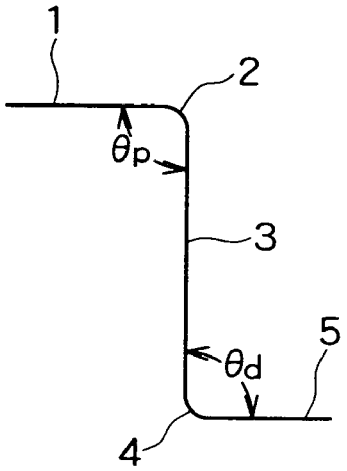
FIG. 1 is a schematic diagram showing a Z-shaped member, and a hat-channel shaped member, in section.

A bent-forming method according to the invention is described in detail hereinafter with reference to the accompanying drawings. With a present embodiment of the invention, there will be described bent-forming of a Z-shaped member (refer to FIG. 1A) with bent angles θp, θd at a first bend 2, and a second bend 4, respectively, being a right angle, in which an angle change defect, and warpage of an inclined flat portion are prone to occur. Since a hat-channel shaped member is formed by coupling the Z-shaped members disposed in bilateral symmetry with each other, the hat-channel shaped member can be regarded as a member similar to the Z-shaped member.

Figure 1B:
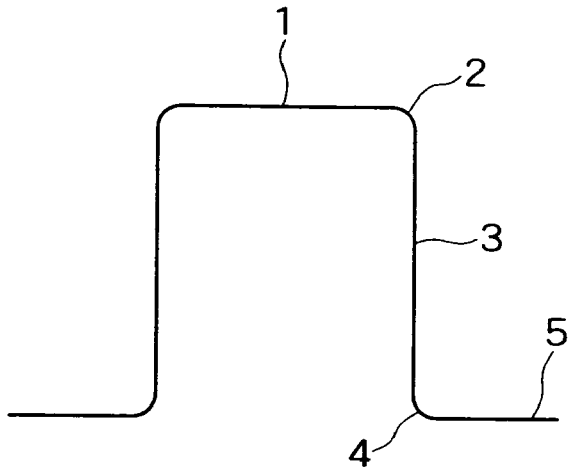
Figure 2:
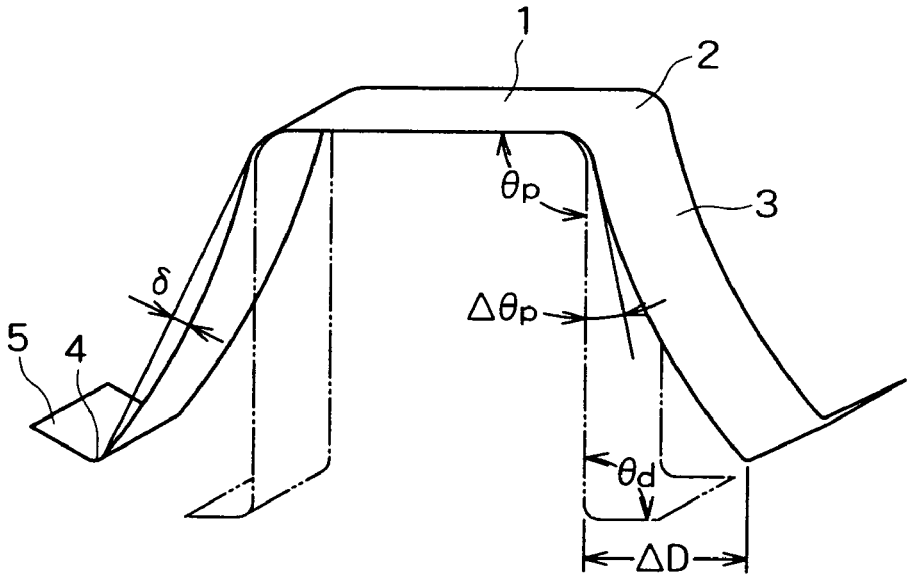
FIG. 2 is a schematic diagram illustrating shape change defects occurring to the hat-channel shaped member.
Figure 3:
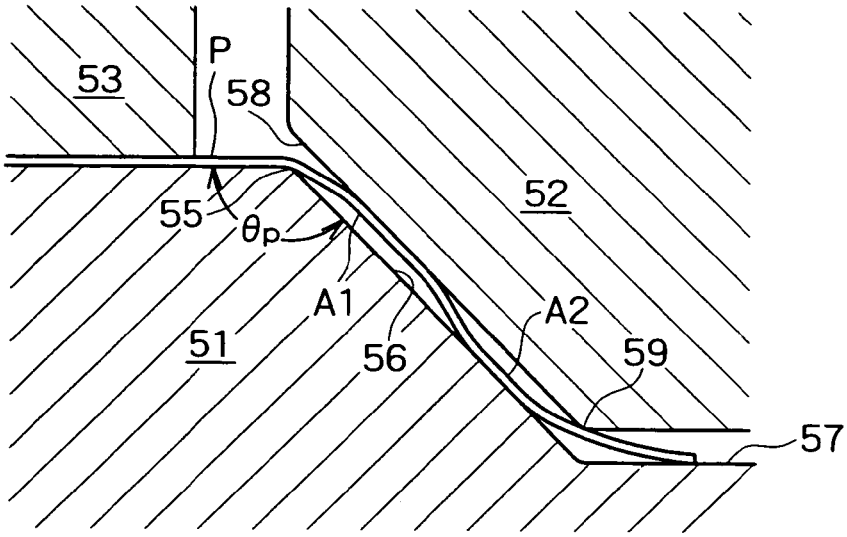
FIG. 3 is a schematic diagram illustrating a deformation behavior (dancing) generating a spring-go component.
Figure 4:
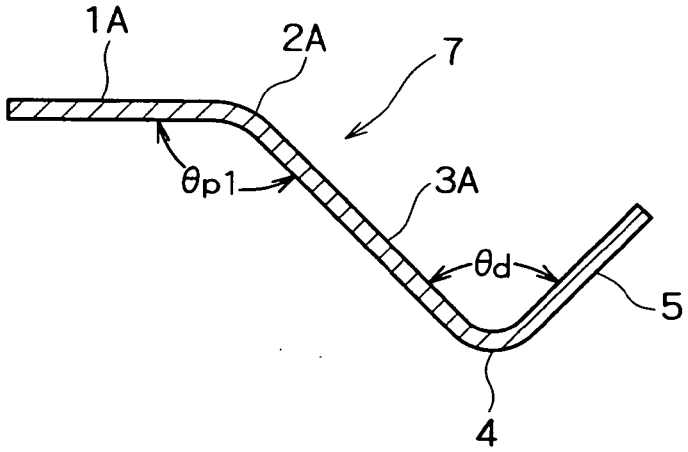
FIG. 4 is a schematic diagram showing a provisional formed member in section, formed in a first forming step.

When forming the Z-shaped member, a provisional formed member 7 comprising a provisional inclined flat portion 3A without any warpage, formed continuously from a provisional horizontal flat portion 1A via a provisional bend 2A, and a flange portion 5 formed continuously from the provisional inclined flat portion 3A via a second bend 4 so as to form a bent angle θd as a target is first bent-formed in a first forming step, as shown in FIG. 4. Next, in a second forming step, the Z-shaped member (refer to FIG. 1) in the target shape is formed out of the provisional formed member 7. In FIG. 4, an angle formed between the provisional horizontal flat portion 1A, and the provisional inclined flat portion 3A of the provisional formed member 7 is shown as θp1 {an angle (a target angle for forming) formed between a provisional horizontal flat forming part of a first forming die described later on, and a provisional inclined flat forming part of the same}, however, the angle formed therebetween actually becomes an angle θp1 plus an angle change Δ θp1.

Figure 5:
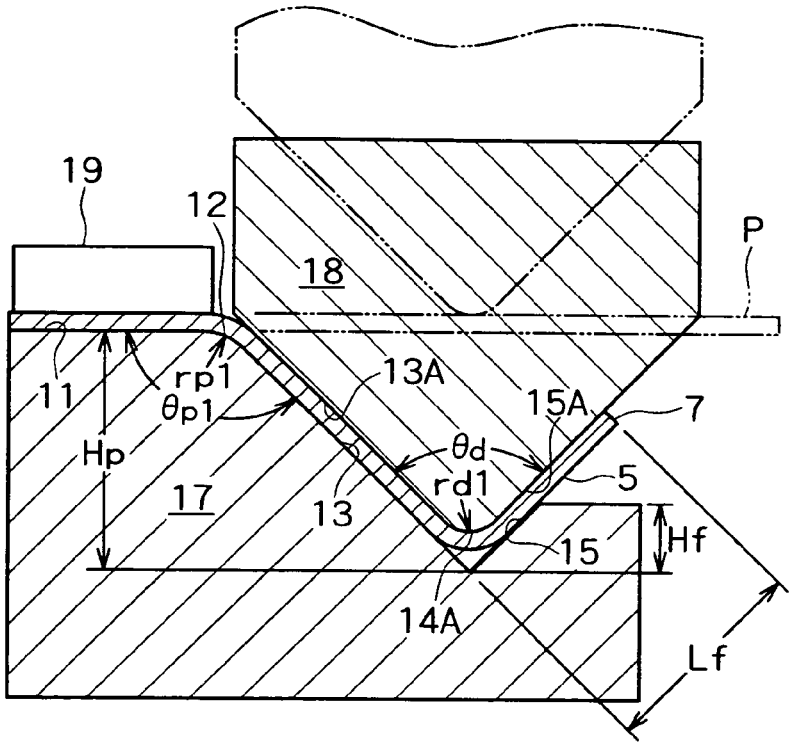
FIG. 5 is a schematic sectional view illustrating a first forming die used in the first forming step.

Now, the first forming die used in the first forming step is described hereinafter. As shown in FIG. 5, the first forming die has a first forming die part (forming punch) 17 comprising a provisional horizontal flat forming portion 11 formed continuously from a provisional inclined flat forming portion 13 via a provisional bend forming portion 12, and a flange forming portion 15 formed continuously from the provisional inclined flat forming portion 13, and a second forming die part (bending blade) 18 comprising a provisional inclined flat forming portion 13A for bent-forming a metal sheet P in conjunction with the provisional inclined flat forming portion 13, and the flange forming portion 15 of the first forming die part 17, respectively, and a flange forming portion 15A formed continuously from the provisional inclined flat forming portion 13A via a bend forming portion 14A. Further, there is provided a presser member 19 for clamping the metal sheet P placed on the provisional horizontal flat forming portion 11 between the provisional horizontal flat forming portion 11, and the presser member 19. In the case of forming the hat-channel shaped member, there is no need for fully securing the metal sheet P to the provisional horizontal flat forming portion 11, so that the presser member 19 can be omitted. The same applies to a second forming die to be described later on.

In the figure, θp1 denotes a bent angle of the provisional bend forming portion 12 (an angle formed between the provisional horizontal flat forming portion 11, and the provisional inclined flat forming portion 13), rp1 a curvature radius of the provisional bend forming portion 12, Hp a height from an intersection part between the provisional inclined flat forming portion 13, and the flange forming portion 15 to the upper face (sheet-pressing face) of the provisional horizontal flat forming portion 11, Hf a height from the intersection part to the upper face of the flange forming portion 15, and rd1 a curvature radius of the bend forming portion 14A of the second forming die part 18. The θp1 is formed so as to become an obtuse angle preferably in a range of 105 to 150° so as to cause occurrence of "dancing" when forming the provisional inclined flat portion 3A.

Figure 7:
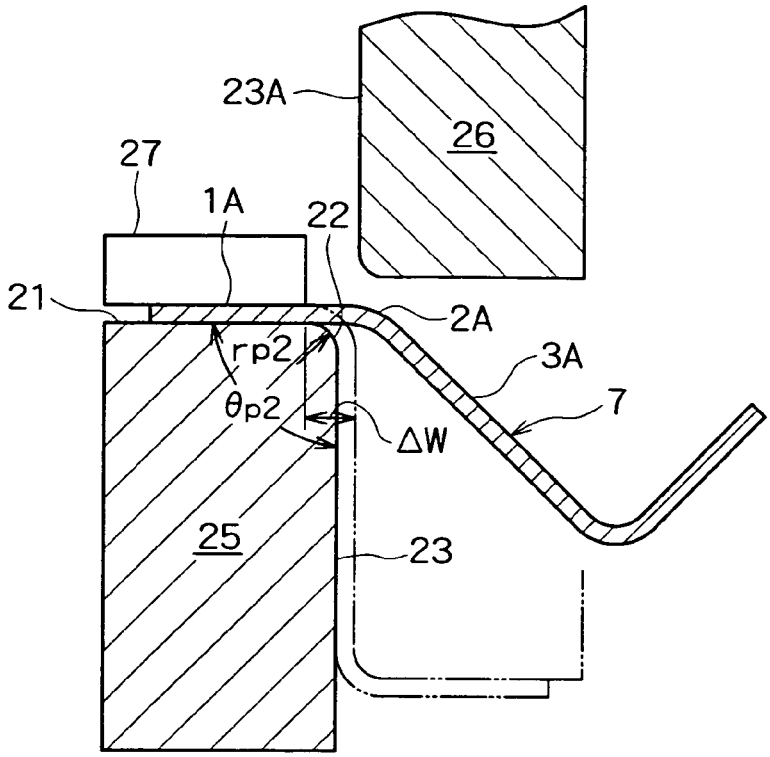
FIG. 7 is a schematic sectional view illustrating a second forming die used in a second forming step.

Meanwhile, as shown in FIG. 7, the second forming die used in the second first forming step has a first forming die part (forming punch) 25 comprising an horizontal flat forming portion 21 formed continuously from an inclined flat forming portion 23 via a bend forming portion 22, and a second forming die part (bending blade) 26 comprising an inclined flat forming portion 23A for forming the provisional horizontal flat portion 1A of the provisional formed member 7 by bending the same along the bend forming portion 22 toward the inclined flat forming portion 23 in conjunction with the inclined flat forming portion 23 of the first forming die part 25. Further, there is provided a presser member 27 for clamping the provisional horizontal flat portion 1A of the provisional formed member 7 placed on the horizontal flat forming portion 21 between the horizontal flat forming portion 21, and the presser member 27.

In the figure, θp2 denotes a bent angle of the bend forming portion 22 (an angle formed between the horizontal flat forming portion 21, and the inclined flat forming portion 23, and in this example, θp2=θp=90°), rp2 a curvature radius of the bend forming portion 22, ΔW an interval between a bending extremity (bend-stop point) of the provisional bend 2A of the provisional formed member 7, on a side thereof, adjacent to the provisional horizontal flat portion 1A, and a bending extremity (bend-stop point) of the bend forming portion 22 of the first forming die part 25, on a side thereof, adjacent to the horizontal flat forming portion 21, in other words, a slippage of the provisional formed member 7.

Figure 6:
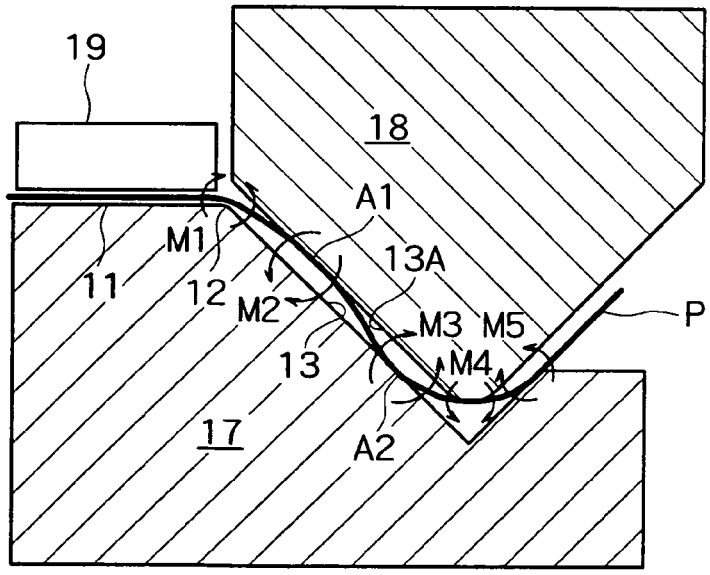
FIG. 6 is a schematic view illustrating a forming state where the dancing has occurred to a provisional inclined flat portion in the first forming step.

The first forming step is described hereinafter with reference to FIG. 5. First, a metal sheet P, such as a high-tension steel sheet, and so forth, is placed on, and held by the provisional horizontal flat forming portion 11 of the first forming die part 17 of the first forming die, and the second forming die part 18 is caused to descend from the inner dead center, thereby forming the metal sheet P into an arch-like shape by bending the same in a slanting and downward direction along the provisional bend forming portion 12. At this point in time, a protuberance of an arch part of the metal sheet P is butted against a forming face of the provisional inclined flat forming portion 13A of the second forming die part 18. Upon the second forming die part 18 being further lowered, there are formed a first arch part A1, and a second arch part A2 of the metal sheet P, having respective protuberances oriented in directions opposite from each other, with protuberance surfaces being butted against the provisional inclined flat forming portion 13A of the second forming die part 18, and the provisional inclined flat forming portion 13 of the first forming die part 17, respectively, as shown in FIG. 6. That is, bent-forming is implemented in such a way as to cause "dancing". In this case, a form of the dancing can be controlled by properly setting θp1 (provided θp1>90°), Hp, Hf, rp1, of the first forming die part 17, and rd1 of the second forming die part 18, so that forming can be implemented so as to have the target angle θd (=90°) without causing warpage occurring to the provisional inclined flat portion 3A of the provisional formed member 7, and furthermore, without causing an angle change defect Δθd occurring to the angle θd formed between the provisional inclined flat portion 3A, and the flange portion 5. In the figure, symbol Lf denotes a flange length, representing a length from the inner face of the inclined flat portion 3 (or the provisional inclined flat portion 3A) to the extremity of the flange portion 5.

In FIG. 6, reference numerals M1 to M5 each denote a bending moment occurring to a formed member when the formed member is restrained with respective forming faces of the first forming die part and the second forming die part by causing the second forming die part 18 to descend down to the bottom dead center, in a state where the dancing is caused to occur. The bending moment M2 acting in a direction for canceling out the warpage δ occurring to the inclined flat portion of the Z-shaped member occurs to a site opposite to the first arch part A1. Meanwhile, M3, M5 occur to sites opposite to the second arch part A2, and the flange potion, respectively, and those bending moments are oriented in directions opposite from the orientation of M4 (a springback component causing the angle change defect Δθd to occur to the second bend) occurring to a site of the Z-shaped member, opposite to the second bend, acting therefore as a spring-go component for canceling out springback occurring to the second bend. Accordingly, when the second forming die part 18 is caused to rise to be released, it is possible to obtain the provisional formed member 7 with the second bend 4 formed so as to have the bent angle θd as predetermined without causing the warpage δ to occur to the provisional inclined flat portion 3A, as shown in FIG. 4.

Figure 8:
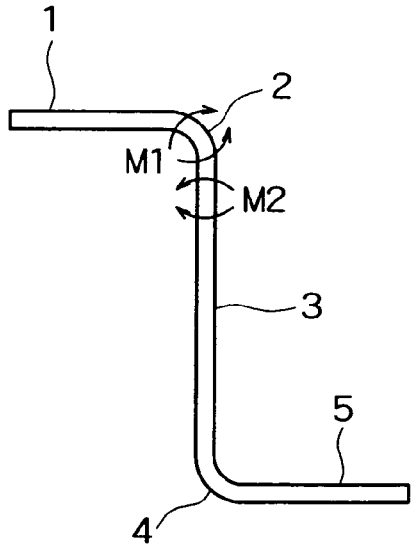
FIG. 8 is a schematic sectional view illustrating a state where a bending moment has occurred to the Z-shaped member restrained by the second forming die in the second forming step.

Subsequently, in the second forming step, the provisional formed member 7 is formed into the target shape. As shown in FIG. 7, the provisional horizontal flat portion 1A of the provisional formed member 7 is placed on, and held by the horizontal flat forming portion 21 of the first forming die part 25 of the second forming die. At this point in time, the provisional horizontal flat portion 1A is placed by preferably shifting the same by ΔW such that a part of the provisional bend 2A overlaps the bend forming portion 22. Then, upon descending of the second forming die part 26, the provisional bend 2A of the provisional formed member 7 is bent back along the inclined flat forming portion 23A of the second forming die part 26 to be thereby extended. A bending moment (M2: a spring-go component) causing elastic recovery to occur toward the first forming die part 25 in a state where the second forming die part 26 is released, as shown in FIG. 8 (showing a restrained state), occurs to a site subjected to such a bending-back force. In this case, by properly setting rp2, and ΔW according to rp1 of the first forming die part 17 of the first forming die, deformation due to elastic recovery occurring upon release, based on the bending moment (M1: the springback component) having occurred to the first bend 2 at the time of restraint cancels out deformation due to elastic recovery occurring upon release, based on the above-described M2, so that the angle change defect can be prevented from occurring to the bent angle θp at the first bend 2. Consequently, it is possible to obtain the Z-shaped member with the respective bent angles θp, θd of the first bend 2, and the second bend 4, being 90°, and having no warpage occurring to the inclined flat portion 3.

Figure 9:
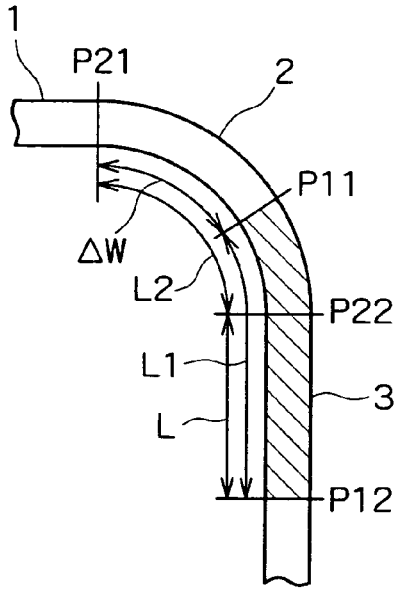
FIG. 9 is a schematic sectional view showing a principal part of a Z-shaped member, upon completion of forming in the second forming step.

Herein, referring to FIG. 9, there is described ΔW (the slippage of the provisional formed member 7) for causing the part of the provisional bend 2A to overlap the bend forming portion 22. FIG. 9 shows a principal part of the Z-shaped member, upon completion of the forming in the second forming step. In the figure, reference numerals P21, P22 denote positions corresponding to the respective bend-stop points of the bend forming portion 22 of the first forming die part 25 of the second forming die, on the sides thereof, adjacent to the horizontal flat forming portion 21, and the inclined flat forming portion 23, respectively, while P11, P12 denote positions corresponding to the respective bend-stop points of the provisional bend forming portion 12 of the first forming die part 17 of the first forming die, on the sides thereof, adjacent to the provisional horizontal flat forming portion 11, and the provisional inclined flat forming portion 13, respectively. Further, L1 denotes a length of a portion bent-formed along the provisional bend forming portion 12, upon completion of the forming in the first forming step (length from P11 to P12), and L2 a length of a portion bent-formed along the bend forming portion 22, upon completion of the forming in the second forming step (length from P21 to P22). Further, L denotes a length extending from P22 to P12, and is represented by the following expression (1) (θp1 in units of degree, and rp1, rp2 in units of mm). As is evident from the figure, a precondition under which the part of the provisional bend 2A is caused to overlap the bend forming portion 22 is ΔW≦L2, however, for part of the provisional bend to undergo deformation by bending back, it is necessary to render L>0. After all, in order to control Δθp, the provisional bend 2A in whole may be subjected to deformation by bending back, so that it is sufficient to set ΔW such that L>0.

$$L=\Delta W+L1-L2$$

$$L1=\pi\times rp1\times(180-\theta p1)/180,\ L2=\pi\times rp2/2$$

Therefore $$L=\Delta W+\pi\times rp1\times(180-\theta p1)/180-\pi\times rp2/2 \quad (1)$$

Further, for forming the Z-shaped member with a small Δθp, it need only be sufficient to set ΔW so as to satisfy the following expression (2). L0 in expression (3) is an L value obtained by finding values of Δθp when steel sheets of various tensile strengths in a range of 340 to 1470 MPa with ΔW being variously changed against θp1 in a range of 105 to 150° are bent-formed as described later, and examining a ratio of Δθp to Δθ max (Δθp/Δθ max) where the max. value of Δθp is defined as Δθ max, whereupon the ratio is found at the min. value. Meanwhile, ΔL in expression (4) is in a range of L/2 where Δθp/Δθ max is on the order of 0.5 or less, that is, Δθp is on the order of Δθ max×½ or less. Any of respective coefficients in those expressions is found by regression analysis on the basis of results of bent-forming according to Embodiment 2 of the invention, described later on. Further, as is evident from Embodiment 2, Δθ max has occurred in a range (L<0) where the provisional bend 2A is not subject to deformation by bending back with any of the steel sheets.

$$L0-\Delta L\leqq L\leqq L0+\Delta L \quad (2)$$

where $$L0=\pi\times rp1\times(180-\theta p1)/180+0.0435\theta p1-6.253 \quad (3)$$

$$\Delta L=-9.96\times10^{-5}\times e^{k}+2.66,\ k=0.163\times(\theta p1-90) \quad (4)$$

Having described the method for bent-forming the Z-shaped member, according to the invention, as above, it is to be pointed out that the same can be applied to a hat-channel shaped member that is formed by disposing the Z-shaped members in bilateral symmetry. Further, the metal sheet to which the method for bent-forming, according to the invention, is applicable is not limited to the steel sheet, and the method for bent-forming, according to the invention, may be applied to an aluminum alloy sheet as well. Further, a pressing apparatus for use in carrying out the invention is not limited to specific type pressing apparatus, and use can be made of an oil hydraulic press, a mechanical press, an opposed hydraulic press, and so forth.

The invention will be described more specifically hereinafter with reference to preferred embodiments of the invention, however, it is our intention that the invention is not to be construed as being limited thereto.

[Embodiment 1]

There are shown specific examples where Z-shaped members each with respective bent angles θp, θd of bends, at 90°, were bent-formed with the use of high-tension cold-rolled steel sheets (40 mm in width) made of 780 MPa class, and 1180 MPa class materials, 1.2 mm in thickness, respectively, by bent-forming respective parts of the respective steel sheets, in the longitudinal direction.

When the first forming step was applied thereto with the use of a first forming die on a dimensional condition of θp1=135°, Hp=37 mm, Hf=37 mm, rp1=5 mm, and rd1=5 mm, dimensional changes having occurred to a provisional formed member 7 were found that Δθp1 at a provisional bend 2A was 2.2°, δ at a provisional inclined flat portion 3A was −0.1 mm, and Δθd at a second bend 4 was 0.5°, in the case of the 780 MPa class material while Δθp1 was 7°, δ was 0.0 mm, and Δθd was 1.0°, in the case of the 1180 MPa class material. It was confirmed from the above that a steep change occurring to Δθp1 at the provisional bend 2A, according to an increase in strength, was observed, however, the provisional formed member 7 was not dependent on a material strength, so that warpage δ at the provisional inclined flat portion 3A as well as Δθd at the second bend 4 was nearly negligible in magnitude.

Next, when the second forming step was applied thereto on a condition of ΔW=4 mm with the use of a second forming die on a dimensional condition of rp2=2 mm, it was found that Δθp=−0.5 in the case of the 780 MPa class material, and Δθp=0.6° in the case of the 1180 MPa class material, indicating that Δθp was not dependent on a material strength, and was nearly negligible in magnitude. Further, with the Z-shaped member obtained by the second forming step, it was confirmed that warpage of an inclined flat portion 3, and Δθd of a second bend 4 were nearly negligible in magnitude similarly to those prior to the application of the second forming step, proving that the second forming step has no effect thereon.

[Embodiment 2]

Two different Z-shaped members with respective bent angles θp, θd of bends, at 90°, an inclined flat portion 50 mm in length, and a flange length Lf in 16 and 26 mm, respectively, were bent-formed with the use of high-tension cold-rolled steel sheets (40 mm in width) at seven different tensile strength levels, made of 340 MPa, 440 MPa, 590 MPa, 780 Mpa, 980 MPa, 1180 MPa, and 1470 MPa class materials, 1.2 mm in thickness, respectively, by bent-forming respective parts of the respective steel sheets, in the longitudinal direction.

Figure 10:
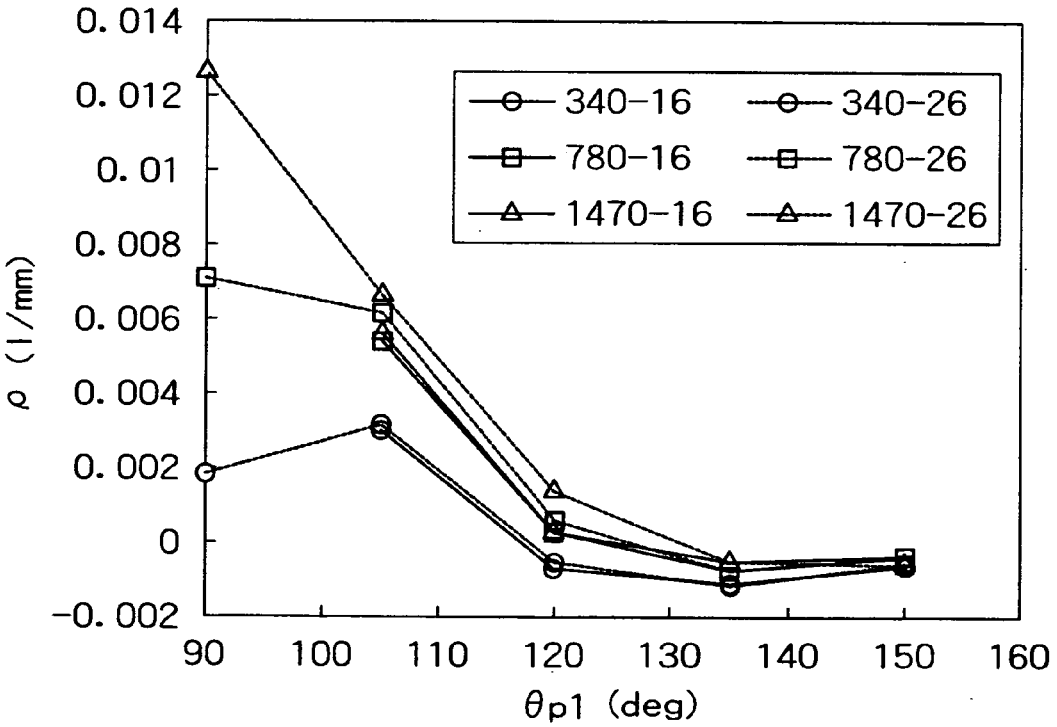
FIG. 10 is a graph showing a relationship between θp1 and curvature ρ of warpage in the cases of steel sheets with various tensile strengths, in the first forming step according to a second embodiment.
Figure 11:
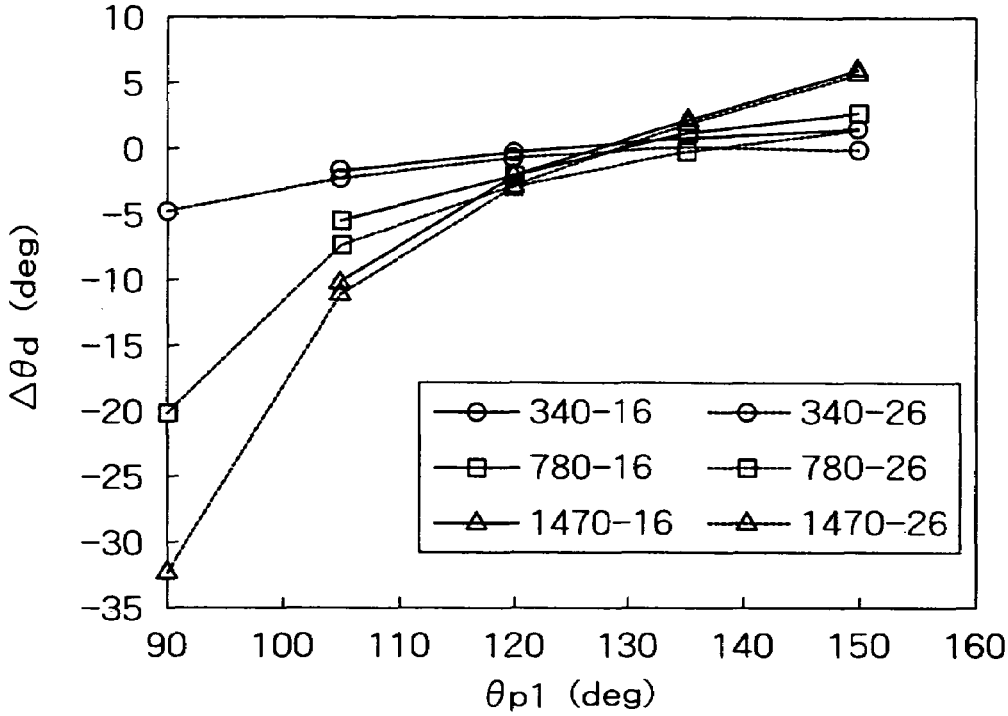
FIG. 11 is a graph showing a relationship between θp1 and Δθd in the cases of the steel sheets with various tensile strengths, in the first forming step according to the second embodiment.
Figure 12:
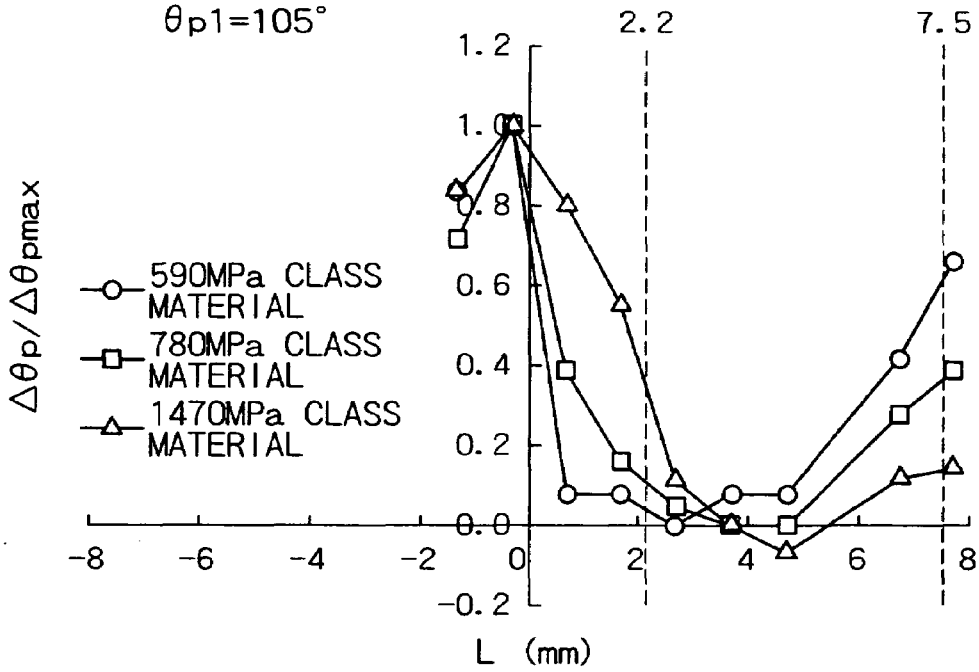
FIG. 12 is a graph showing a relationship between L and Δθp/Δθ max in the case of rp2=5 mm, and θp1 at 105° in the second forming step according to the second embodiment.
Figure 13:
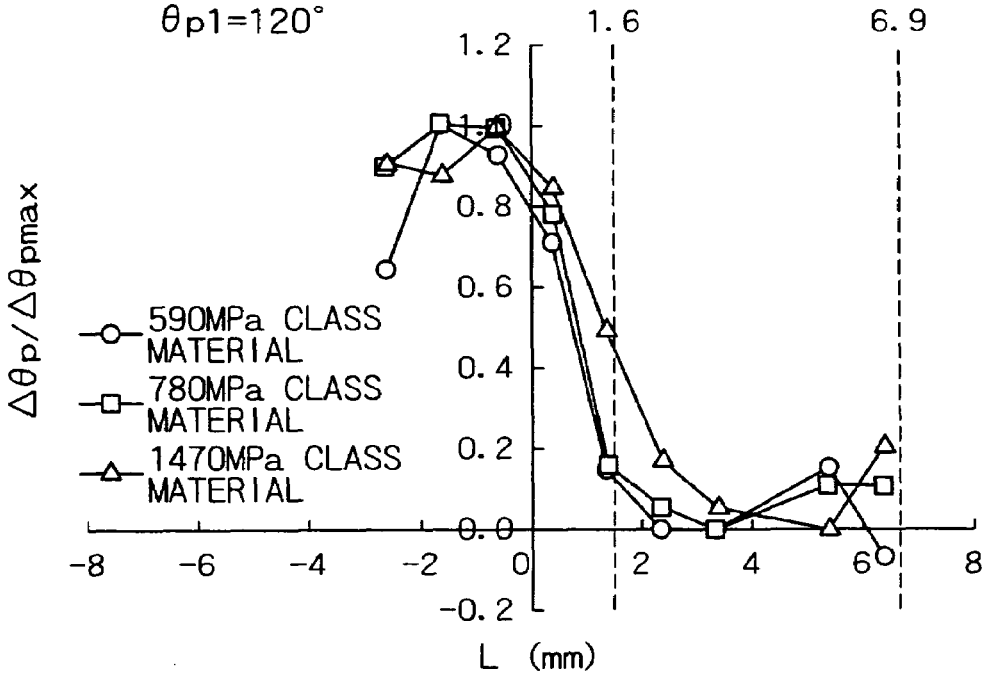
FIG. 13 is a graph showing a relationship between L and Δθp/Δθ max in the case of rp2=5 mm, and θp1 at 120° in the second forming step according to the second embodiment.
Figure 14:
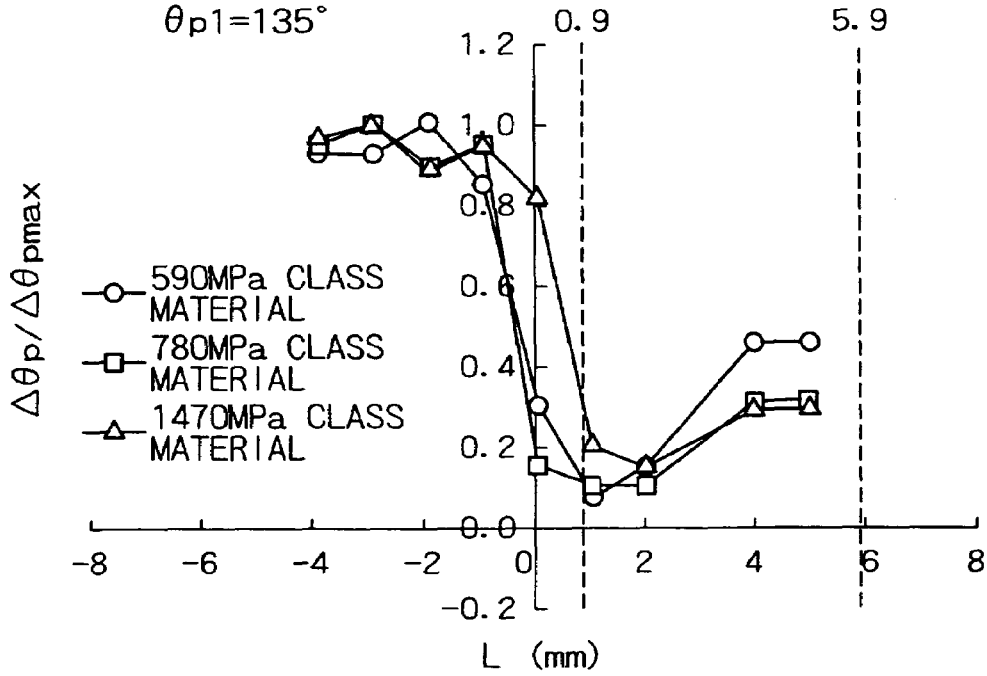
FIG. 14 is a graph showing a relationship between L and Δθp/Δθ max in the case of rp2=5 mm, and θp1 at 135° in the second forming step according to the second embodiment.
Figure 15:
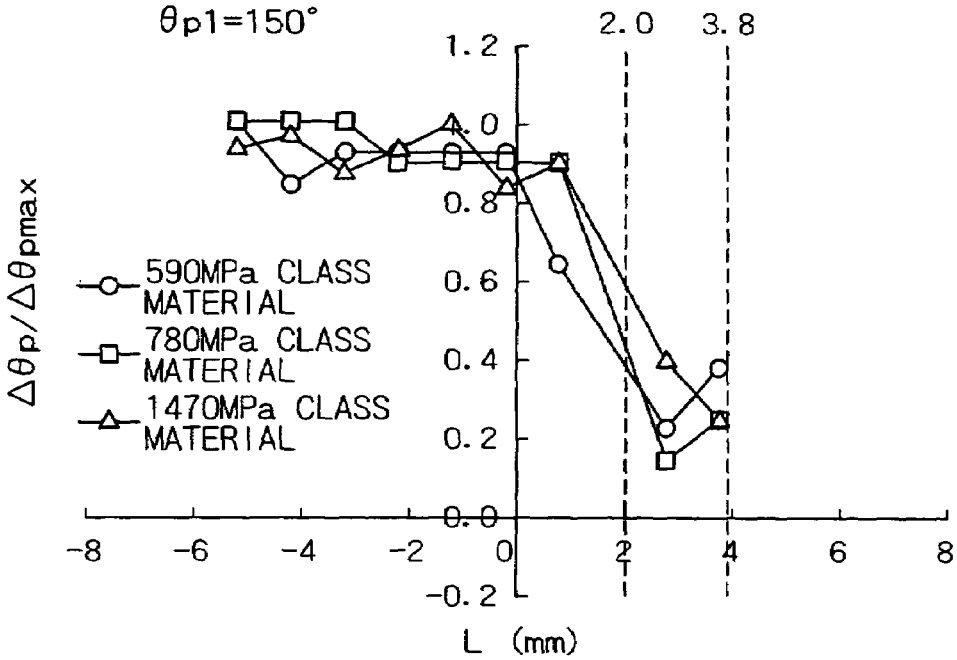
FIG. 15 is a graph showing a relationship between L and Δθp/Δθ max in the case of rp2=5 mm, and θp1 at 150° in the second forming step according to the second embodiment.

The first forming step was applied thereto with the use of a first forming die on a dimensional condition of θp1 at 5 different degrees of 90°, 105°, 120°, 135°, 150°, Hp=37 mm, Hf=37 mm, rp1=5 mm, and rd1=5 mm. FIGS. 10 and 11 show the results of application of the first forming step by way of example. In the figures, the first number in each of data series indicates the tensile strength level (MPa), and the second number the flange portion length Lf (mm). For example, "340–16" indicates the 340 MPa class materials with Lf 16 mm. Further, in FIG. 10, the vertical axis represents curvature ρ(ρ=1/R where a radius of curvature is R) of warpage of a provisional inclined flat portion of a provisional formed member, thereby showing magnitude of the warpage. The radius R of the curvature was found by the following procedure. By placing a measurement terminal of a dial gauge at the center in the widthwise direction of the steel sheet, corresponding to a center position between bend-stop points at respective ends of the provisional inclined flat portion 3A of the provisional formed member, and taking a measurement span (23 mm) in the longitudinal direction of the provisional inclined flat portion, the maximum deflection ΔR within the measurement span was measured, and R was found by the following expression (three square theorem).

$$R^2=(R-\Delta R)^2+(\text{measurement span}/2)^2$$

Based on those figures, there are observed effects of suppressing the curvature ρ of the warpage, and Δθd when θp1 was caused to fall in the range of 105 to 150°, equivalent to, or greater than those when use was made of a normal forming die with θp1 at 90°. Further, it was confirmed that the higher the strength of a high-tension steel sheet of not lower than 590 Mpa class, the more pronounced such effects became.

Figure 16:
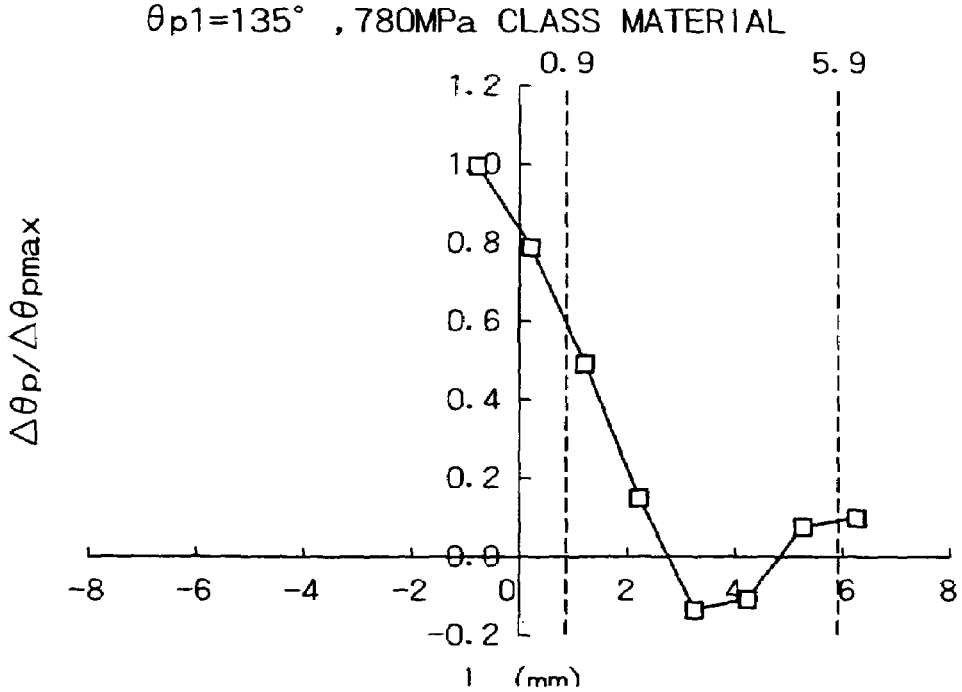
FIG. 16 is a graph showing a relationship between L and Δθp/Δθ max in the case of rp2=3 mm, and θp1 at 135° in the second forming step according to the second embodiment.

Next, the second forming step using a second forming die on a dimensional condition of rp2=5 mm with ΔW being variously set was applied to the provisional formed member obtained by the first forming step described as above. FIGS. 12 to 15 show examples (Lf=26 mm) of the results of the second forming step. Further, FIG. 16 shows an example (Lf=26 mm) of the results of the second forming step using a second forming die with rp2=3 mm with ΔW being variously set. In the respective figures, the horizontal axis represents L (mm) defined by the above-described expression (1), and respective scopes of intervals in a dotted line indicate scopes of L0−ΔL≦L≦L0+ΔL shown by the above-described expression (2). Further, the vertical axis represents the ratio Δθp/Δθ max.

It is evident from those figures that if ΔW is set such that L falls in a range of L0±ΔL, this will cause Δθp to be reduced by about 50% in comparison with Δθ max, indicating that significant effect of reducing Δθp can be gained.

What is claimed is:

1. A bent-forming method for bent-forming a metal plate into a Z-shaped member, or a hat-channel shaped member, having a horizontal flat portion, an inclined flat portion with one end thereof coupled to one end of the horizontal flat portion via a first bend of not greater than about 90°, and a flange portion coupled to the other end of the inclined flat portion via a second bend of not greater than about 90°, said bent-forming method comprising:

a first forming step for bent-forming the metal plate into a provisional formed member having a provisional inclined flat portion with one end thereof coupled to one end of a provisional horizontal flat portion via a provisional bend having an obtuse angle, the other end of the provisional inclined flat portion being coupled to a flange portion in the first forming step via the second bend of not greater than about 90°, wherein the provisional inclined flat portion undergoes deformation so as to form two arch parts thereof having respective protuberances oriented in directions opposite from each other between respective provisional inclined flat forming portions of forming die parts in pairs; and a second forming step for forming the horizontal flat portion, first bend of not greater than about 90° and inclined flat portion so as to be continuously coupled with each other, out of the provisional horizontal flat portion, provisional bend, and provisional inclined flat portion of the provisional formed member, respectively, wherein the provisional horizontal flat portion of the provisional formed member is bent-formed while bending back the provisional bend.

2. The bent-forming method according to claim 1, further comprising the steps of:

preparing a first forming die comprising a first forming die part having a provisional horizontal flat forming portion coupled to a provisional inclined flat forming portion via a provisional bend forming portion, and a flange forming portion coupled to the provisional inclined flat forming portion, and a second forming die part having a provisional inclined flat forming portion for bent-forming the metal sheet in conjunction with the provisional inclined flat forming portion, and the flange forming portion of the first forming die part, respectively, and a flange forming portion; and preparing a second forming die comprising a first forming die part having an horizontal flat forming portion coupled to an inclined flat forming portion via a bend forming portion, and a second forming die part having an inclined flat forming portion for bent-forming the provisional horizontal flat portion of the provisional formed member along the bend forming portion in conjunction with the inclined flat forming portion of the first forming die part of the second forming die, wherein, in the first forming step, the second forming die part of the first forming die is caused to make relative displacement against the first forming die part of the first forming die, and the metal sheet placed on, and held by the provisional horizontal flat forming portion of the first forming die part is thereby bent into an arch-like shape along the provisional bend forming portion of the first forming die part in such a way as to undergo deformation such that a first arch part, and a second arch part of the metal sheet, having respective protuberances oriented in directions opposite from each other, with protuberance surfaces being butted against the provisional inclined flat forming portion of the second forming die part, and the provisional inclined flat forming portion of the first forming die part, respectively, are coupled with each other, thereby forming the provisional formed member having the provisional inclined flat portion with the one end thereof, coupled to the one end of the provisional horizontal flat portion via the provisional bend, the other end of the provisional inclined flat portion, being coupled to the flange portion via the second bend while, and wherein, in the second forming step, the provisional horizontal flat portion of the provisional formed member is bent-formed by causing the second forming die part of the second forming die to make relative displacement against the first forming die part of the second forming die and the provisional bend is formed by bending back.

3. The bent-forming method according to claim 1, wherein the angle θp1 is set in a range of 105 to 150°.

4. The bent-forming method according to claim 1, wherein the provisional horizontal flat portion of the provisional formed member is placed on the horizontal flat forming portion of the first forming die part of the second forming die after a bend-stop point of the provisional bend of the provisional formed member, on a side thereof, adjacent to the provisional horizontal flat portion is slid outward from a bend-stop point of the bend forming portion of the first forming die part of the second forming die, on a side thereof, adjacent to the horizontal flat forming portion in the second forming step, thereby executing forming by bending-back such that a part of the provisional bend of the provisional formed member overlaps the bend forming portion of the first forming die part of the second forming die.

5. The bent-forming method according to claim 1, wherein if L is expressed by the following expression (1):

$$L=\Delta W+\pi\times rp\mathbf{1}\times(180-\theta p\mathbf{1})/180-\pi\times rp\mathbf{2}/2 \quad (1)$$

where rp1 is a curvature radius of the provisional bend forming portion of the first forming die part of the first forming die, rp2 a curvature radius of the bend forming portion of the first forming die part of the second forming die, and ΔW a slippage of the provisional formed member, ΔW is provided so as to satisfy the following expression (2):

$$L\mathbf{0}-\Delta L\leqq L\leqq L\mathbf{0}+\Delta L \quad (2)$$

where $$L\mathbf{0}=\pi\times rp\mathbf{1}\times(180-\theta p\mathbf{1})/180+0.0435\ \theta p\mathbf{1}-6.253$$

$$\Delta L=-9.96\times10^{-5}\times e^{k}+2.66,$$

$$K=0.163\times(\theta p\mathbf{1}-90).$$

* * * * *